United States Patent [19]

Sands

[11] Patent Number: 4,686,411

[45] Date of Patent: Aug. 11, 1987

[54] INCANDESCENT LAMP HAVING AN IMPROVED AXIAL MOUNTING STRUCTURE FOR A FILAMENT

[75] Inventor: Robert W. Sands, Hudson, Ohio

[73] Assignee: General Electric Company, Schenectady, N.Y.

[21] Appl. No.: 805,668

[22] Filed: Dec. 6, 1985

[51] Int. Cl.[4] ..... H01J 1/88; H01J 19/42; H01K 1/18

[52] U.S. Cl. ..... 313/271; 313/315

[58] Field of Search ..... 313/271, 315

[56] References Cited

U.S. PATENT DOCUMENTS 4,249,101 2/1981 Walsh ..... 313/271

4,422,009 12/1983 Shaffer ..... 313/271

*Primary Examiner*—Saxfield Chatmon

*Attorney, Agent, or Firm*—John P. McMahon; Philip L. Schlamp; Fred Jacob

[57] ABSTRACT

An improved mounting structure for spatially disposing from its long axial conductive member, a filament within the outer envelope of an incandescent lamp is disclosed. The mounting structure offsets the filament from the centerline of the lamp and from its conductive members so as to substantially reduce the typically experienced arcing condition between the conductive members of the mounting structure and the filament.

2 Claims, 2 Drawing Figures

INCANDESCENT LAMP HAVING AN IMPROVED AXIAL MOUNTING STRUCTURE FOR A FILAMENT

BACKGROUND OF THE INVENTION

The present invention relates to an improved structure for axially mounting a filament within an incandescent lamp.

The mounting of filaments within incandescent lamps may be accomplished in an axial or vertical manner, commonly termed CC8, or in a transverse or horizontal manner commonly termed CC6. The transverse mounting is beneficial with regard to the strength of the mounted filament, but the light output yielded by such transverse mounting is less than that obtainable from axial mounting. The axial mounting places the filament lengthwise or axially along the centerline of the lamp which is optically beneficial in providing approximately four (4) percent more light output relative to a transverse placement of the filament within the lamp.

The maximum spacing between the conductive members of both the axial and transverse mounting of the filament is limited by the diameter of the neck portion of the lamp in that both mounting structures are inserted into the confines of the lamp by way of the neck portion during the manufacturing process of the lamp. In an axially oriented filament, the maximum spacing between the filament and the conductive member of the mount which runs lengthwise of the filament, is determined by the desired position of the filament, relative to the lamp. From performance considerations, when the filament is positioned on the centerline of the lamp, this maximum spacing distance is about one-half ($\frac{1}{2}$) of the diameter of the neck portion.

One of the factors of this performance is related to the gas convection around the filament. When the filament is positioned on the centerline of the lamp, essentially and advantageous only a single hot-spot accurs at the top, central portion of the lamp. When the position of the filament is shifted off of the centerline, a hot spot is created at the top portion of the lamp, and also at the side of the lamps. Typically these hot-spots are suspected to contribute to degrading the life expectancy of the lamps making the centerlined positioning of the filament advantageous. Further, from aesthetic considerations in lamps having a clear or frosted outer envelope, the customer expects the filament to be positioned at the centerline of the lamp.

In axially oriented filaments, an arcing problem may commonly occur between the filament and the conductive member of the mounting structure that runs alongside the filament. This arcing problem is particularly noticeable in low wattage filaments having thin wire sizes in that the thin wire sizes are lacking in strength, and when subjected to bending and sagging actions, the filament may move away from its initial position and find its way to close proximity of the conductive member, thus allowing for an arcing condition to be created. It is desired that means be provided which reduces this possible arcing condition so that the axial oriented filament may be used in lamps to thereby maintain the benefits of the increased light output relative to transverse oriented filaments.

Accordingly it is an object of the present invention to provide means for reducing the arcing conditions, between the filament and the conductive member that runs alongside of the filament, typically experienced by filaments oriented in an axial manner within an incandescent lamp.

SUMMARY OF THE INVENTION

This invention is directed to an improved mounting arrangement which orients the filament of an incandescent lamp in an axial manner and also reduces the typically experienced arcing conditions of the oriented filament.

The incandescent lamp comprises an outer envelope having a neck portion with a predetermined diameter, an electrically conductive base connected to the neck portion, a filament, and a mount arrangement for spatially disposing the filament within the outer envelope in an axial manner offset from the centerline of the lamp by an amount greater than one-half ($\frac{1}{2}$) of said neck diameter, but less the whole of said diameter of said neck portion. The mounting arrangement comprises an insulated stem member and a pair of conductive members with one being longer than the other. The conductive members each have a first end connected respectively across the filament. The second end of each conductive member is appropriately connected to the electrically conductive base. The connective filament is separated from the longer conductive member which is parallel to said filament by a distance greater than one-half ($\frac{1}{2}$) of said neck diameter but less than the whole of said neck diameter.

DETAILED DESCRIPTION OF PREFERRED EMBODIMENTS

Figure 1:
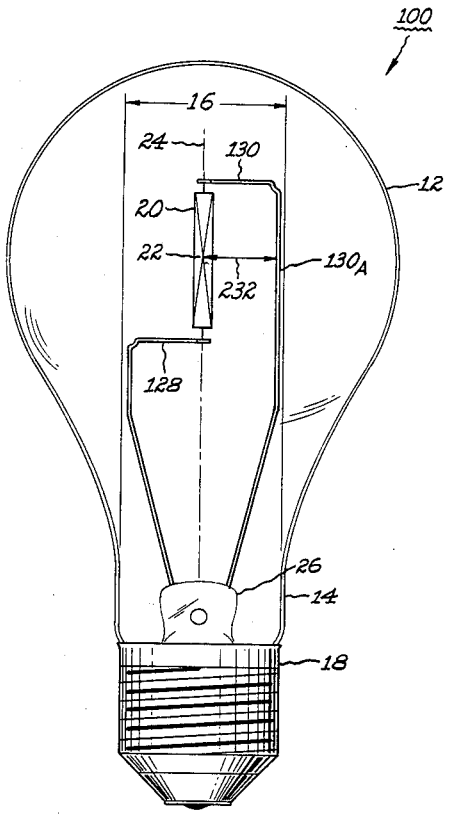
Fig. 1 (PRIOR ART)
FIG. 1 illustrates a prior art incandescent lamp having an axially mounted filament susceptible to an arcing condition.

FIG. 1 illustrates a prior art incandescent lamp 100 not having the benefits of the present invention. The lamp 100 has an outer envelope of a pear shape commonly referred to as an A-line shape. The outer envelope 12 has a neck section 14 with a predetermined diameter 16. The neck section 14 is connected to an electrically conductive screw-in base 18. The lamp 100 has a tungsten filament 20, having a mid-portion 22 which is axially aligned along the centerline 24 of the lamp 100. The mounting of the centerlined filament 20 is provided by an insulative member 26 and a pair of electrically conductive members 128 and 130 having portions encased in the stem 26. The pair of conductive members 128 and 130 each have a first end respectively connected across the filament 20. The second end of the members 128 and 130 is appropriately conneced to the base 18.

The conductive member 130 is longer than member 128 and has major portion of $\mathbf{130}_A$ which is longitudinally arranged and runs alongside in a parallel manner with the filament 20. The maximum separation between conductor members 128 and 130 is substantially equal to but less than the diameter 16 so that the members 128 and 130, having the connected filament 20 thereacross, may be positioned within the confines of outer envelope 12 by entrance from the neck portion 14 during the manufacturing process of lamp 100. From the performance and aesthetic considerations discussed in the "Background" section, the mid-portion 22 of filament 20 is arranged on the centerline 24 of lamp 100. Such an arrangement limits the separation of distance 232 between the mid-portion 22 of the filament 20 and the conductive member portion $\mathbf{130}_A$ to a value for an A-19 size lamp of about 11.5±1.0 mm.

The axial arrangement of filament 20 within the outer envelope 12 may typically experience an arcing problem between the filament 20 and portion $\mathbf{130}_A$ of member 130. This arcing problem is particularly noticed for an axial mounting of a low wattage filament. The low wattage filaments are typically comprised of wires having diameter sizes that are lacking in strength and low in their resistence to sagging and bending. Such wires commonly experience bending and sagging. With a horizontal burning lamp, the coil sags downward due to gravity and if the long lead portion $\mathbf{130}_A$ is below the filament because of its orientation with the threads of the base, the filament sags toward the long lead portion $\mathbf{130}_A$. Such sagging may be sufficient to decrease the distance 232 to such an amount which allows the electrons flowing through filament to arc across the conductive member $\mathbf{130}_A$ causing failure of the filament.

In my initial encounter of this arcing problem, one of my main considerations was to provide means which substantially preserved the benefits of increased light output of the axial mounting relative to transverse location mounting. The means to be provided should substantially reduce the arcing problem while only causing a slight degradation of the performance, in particular, the life of the axially mounted filament. Such means may be described with reference to FIG. 2.

Figure 2:
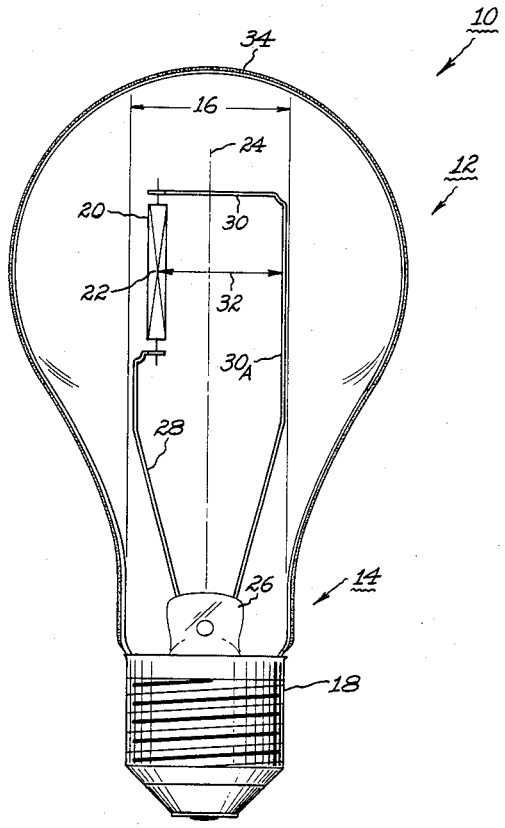
FIG. 2 illustrates an incandescent lamp in accordance with the present invention that substantially reduces the prior art arcing problem of the incandescent lamp.

FIG. 2 shows an incandescent lamp 10 in accordance with the present invention having a major portion of its elements with reference numbers previously described with regard to FIG. 1. The substantial difference between the incandescent lamp 10 and the prior art lamp 100 is the axial mounting arrangement of the filament 20. The mounting arrangement of lamp 10 spatially disposes filament 20 within the outer envelope in an axial manner, and offsets the filament from the centerline of the lamp 10 by an amount greater than one-half ($\frac{1}{2}$) of the neck diameter 16 but less than the complete or whole amount of the predetermined diameter 16 of the neck portion 14.

The mounting arrangement of lamp 10 comprises an insulated stem member 26 and a pair of conductive members 28 and 30. The connections of the conductive members 28 and 30 to the filament 20 and base 18 are similar to the previously described connections of members 128 and 130. Conductive member 30 is the longer of the two members and has a portion $\mathbf{30}_A$ arranged in a parallel manner relative to filament 20 and separated thereby by a distance 32 which is shown in FIG. 2 as substantially equal to but less than the diameter 16.

The distance 32 is of primary importance in the present invention and is in the range of about 20 mm to about 28 mm for an A19 size lamp which distance is an increase over the distance 232, by a factor of about 2. The distance 32 increases, relative to distance 232, the possible gap that the electron must jump from the filament 20 to the conductive portion $\mathbf{30}_A$ in order to begin the arcing process. Given that the filament 20 bends and sags with the same degree as when placed in prior art lamp 100, the mounting arrangement shown in FIG. 2 substantially reduces the possible occurrence of the described arcing condition relative to the mounting arrangement described with reference to FIG. 1.

The arrangement of the offset filament 20 of FIG. 2 with regard to the aesthetic effects related to the customer viewing of the filament, is compensated for by an electrostatic coating 34 placed on the outer envelope 12 so as to substantially hide the orientation of the offset, axially aligned filament 20.

The offset axial alignment of the filament with regard to the performance of lamp 10 was investigated. The investigation revealed that the anticipated life of lamp 10 decreased by a small factor, less than 1%, relative to lamp 100. Similarly, the light output of the lamp 10 decreased by a small factor, less than 1%, relative to lamp 100. However, the light output of the lamp 10 having the offset axial filament had about a four (4) percent increase relative to a lamp having a transverse oriented filament. Further the possible arcing condition of lamp 10 decreased by a factor of 59% relative to lamp 100.

It should now be appreciated that practice of the present invention provides means for reducing the typically experienced arcing condition of the filament particularly associated with low wattage filaments having an axial orientation while substantially providing all of the benefits of increased output relative to transverse mounted filaments.

It should be further appreciated that although the previously given description was related to an A-line 19 lamp, the principles of the present invention equally apply to other lamps desiring axially oriented filaments and providing such orientation with a substantially reduced arcing condition.

What I claim is:

1. An incandescent lamp comprising;

an outer envelope having a neck portion with a predetermined diameter;

an electrically conductive base connected to said neck portion;

a filament;

A mounting arrangement for spatially disposing said filament within said envelope in an axial manner off-set from the centerline of the lamp by an amount greater than one-half ($\frac{1}{2}$) of said neck diameter but less than the diameter of the neck portion, the mounting arrangement comprising;

an insulative stem member; and a pair of conductive members with one being of length greater than the other, each of said conductive members having a first end respectively connected across said filament, the second end of each of said conductive members being appropriately connected to said electrically conductive base, said connected filament being separated from the portion of the longer conductive member which is parallel to said filament by a distance greater than one-half of said neck diameter but less than whole of said neck diameter said filament separation from said portion of said longer conductive member being effective for reducing the arcing condition between said filament and said longer conductive member.

2. An incandescent lamp according to claim 1 wherein aid filament is offset from the centerline of said lamp and said filament is separated from said portion of said longer conductive member each by a distance of about 20 mm to about 28 mm.

* * * * *